US009917351B2

(12) United States Patent
Tai

(10) Patent No.: US 9,917,351 B2
(45) Date of Patent: Mar. 13, 2018

(54) ANTENNA AND ANTENNA ASSEMBLY

(71) Applicant: FOXCONN INTERCONNECT TECHNOLOGY LIMITED, Grand Cayman (KY)

(72) Inventor: Lung-Sheng Tai, New Taipei (TW)

(73) Assignee: FOXCONN INTERCONNECT TECHNOLOGY Limited, Grand Cayman (KY)

( * ) Notice: Subject to any disclaimer, the term of this patent is extended or adjusted under 35 U.S.C. 154(b) by 7 days.

(21) Appl. No.: 15/095,171

(22) Filed: Apr. 11, 2016

(65) Prior Publication Data

US 2016/0301124 A1 Oct. 13, 2016

(30) Foreign Application Priority Data

Apr. 9, 2015 (TW) ..... 104111356 A

(51) Int. Cl.

| | |
|---|---|
| ***H01Q 1/24*** | (2006.01) |
| ***H01Q 13/10*** | (2006.01) |
| ***H01Q 1/22*** | (2006.01) |
| ***H01Q 21/28*** | (2006.01) |
| ***H01Q 5/371*** | (2015.01) |
| *H01Q 9/04* | (2006.01) |

(52) U.S. Cl.

CPC ..... *H01Q 1/243* (2013.01); *H01Q 1/2258* (2013.01); *H01Q 5/371* (2015.01); *H01Q 13/10* (2013.01); *H01Q 13/103* (2013.01); *H01Q 21/28* (2013.01); *H01Q 9/0407* (2013.01)

(58) Field of Classification Search

CPC ..... H01Q 1/2258; H01Q 1/243; H01Q 5/371; H01Q 9/0407; H01Q 13/103; H01Q 21/28

See application file for complete search history.

(56) References Cited

U.S. PATENT DOCUMENTS

2012/0139809 A1* 6/2012 Saito ..... H01Q 1/48 343/848
2014/0292587 A1* 10/2014 Yarga ..... H01Q 1/243 343/702
2015/0061941 A1* 3/2015 Hill ..... H01Q 1/38 343/700 MS
2016/0036129 A1 2/2016 Hwang et al.

FOREIGN PATENT DOCUMENTS

JP WO 2013187013 A1 * 12/2013 ..... H01Q 1/2233

* cited by examiner

*Primary Examiner* — Hoang Nguyen
(74) *Attorney, Agent, or Firm* — Wei Te Chung; Ming Chieh Chang

(57) ABSTRACT

An antenna comprises a main body and a cable connecting to the main body. The main body has a grounding portion, a cantilevered arm, a first connecting portion and a second connecting portion. The first connecting portion connects the grounding portion and the cantilevered arm. The first connecting portion is located at the upper side of the cantilevered arm and defines a first slot with the cantilevered arm. The second connecting portion connects the grounding portion and the cantilevered arm. The second connecting portion is located at the lower side of the cantilevered arm and defines a second slot with the cantilevered arm.

18 Claims, 6 Drawing Sheets

ANTENNA AND ANTENNA ASSEMBLY

1. FIELD OF THE INVENTION

The present invention relates to an antenna assembly, particularly relates to an antenna assembly for wireless data transmission.

2. DESCRIPTION OF THE PRIOR ART

With the development of electronic technology, more and more mobile electronic devices are equipped with wireless transceiver for wireless signal transmission. The antenna is often integrated in the electronic device. In the traditional technology, the antenna is integrated in the electronic device with screw or glue. However, with the miniaturization development trend of the electronic device, the internal space of the electronic device will become smaller and smaller, and the size of the antenna will become smaller and smaller. This increases the difficulty for installing the antenna to the electronic device and needs more time for assembling the antenna to the electronic device. It reduces the production efficiency of the electronic device.

It is desired to obtain an improved antenna assembly.

SUMMARY OF THE INVENTION

Accordingly, an object of the present invention is to provide an improved antenna assembly.

In order to achieve the object set forth, an antenna comprises a main body having a grounding portion, a cantilevered arm facing to the grounding portion, a first connecting portion and a second connecting portion. The first connecting portion connects the grounding portion and the cantilevered arm. The first connecting portion is located above the cantilevered arm and defines a first slot with the cantilevered arm. The second connecting portion connects the grounding portion and the cantilevered arm. The second connecting portion is located under the cantilevered arm and defines a second slot with the cantilevered arm. The cantilevered arm has a free end close to the grounding portion a signal feeding point thereon. the grounding portion having a grounding feeding point thereon; and a feeder cable connecting to the main body.

DESCRIPTION OF PREFERRED EMBODIMENT

Reference will now be made to the drawings to describe the present invention in detail.

Figure 1:
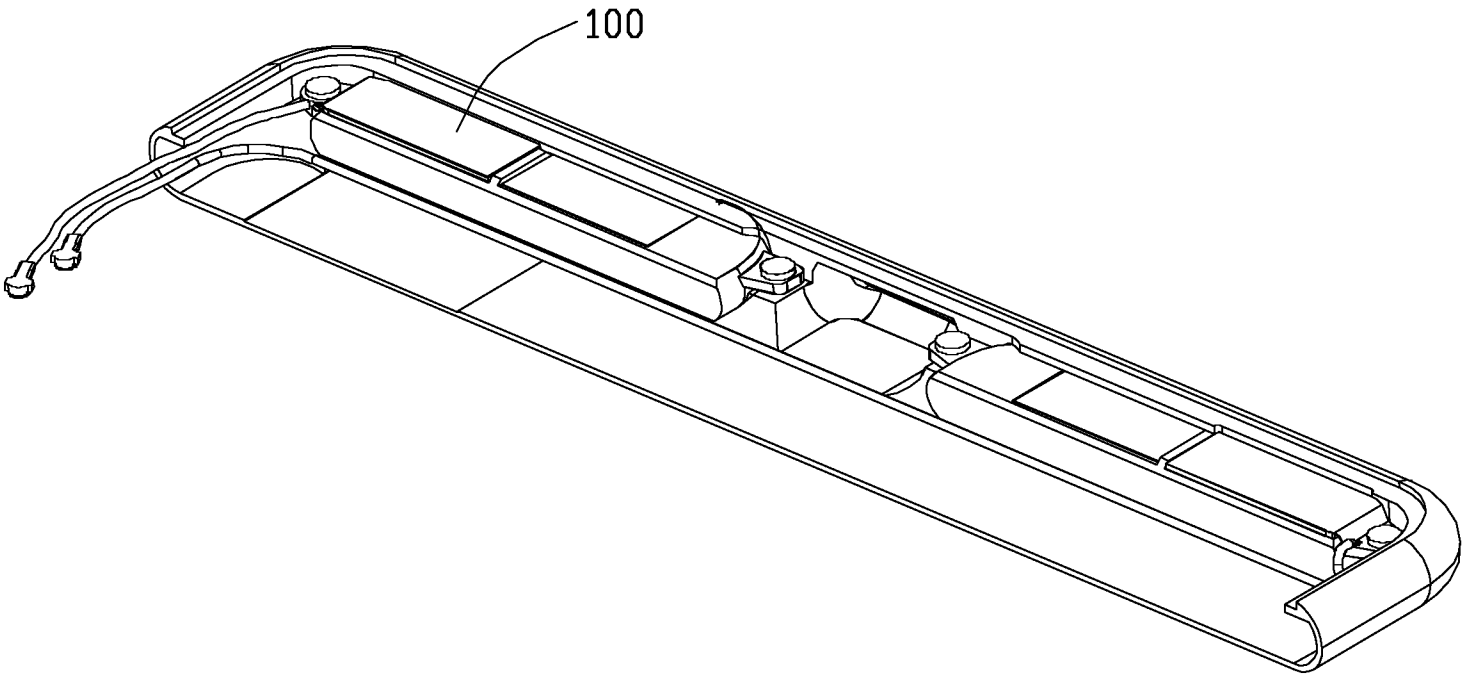
FIG. 1 is an assembled perspective view of an antenna assembly in accordance with the present invention.
Figure 2:
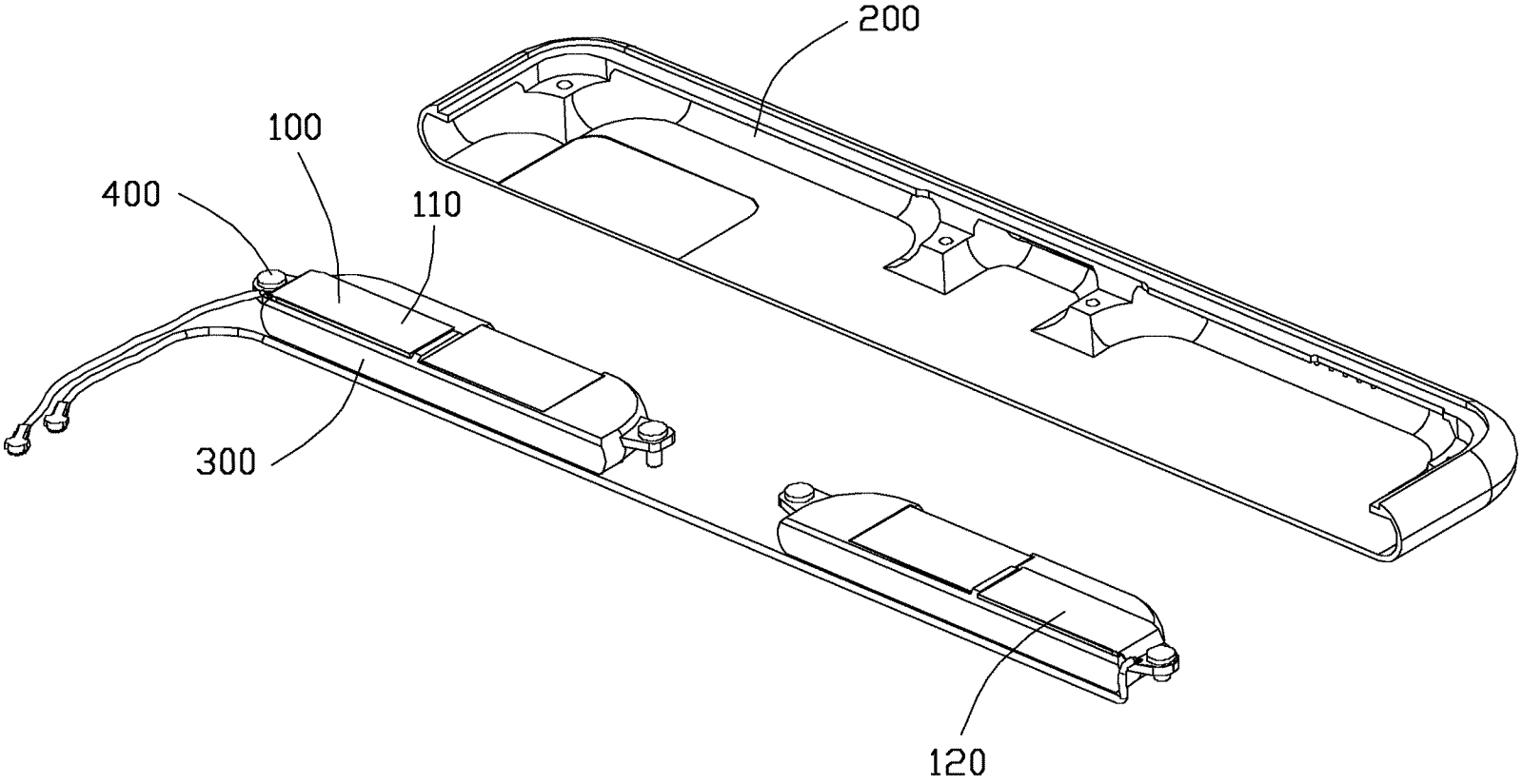
FIG. 2 is an exploded perspective view of the antenna assembly of FIG. 1.

Referring to FIGS. 1-2, an antenna assembly includes a plurality of antennas 100, a metal shell 200, a plurality of speakers 300 and a plurality of screws 400. The antennas 100, the speakers 300 and the metal shell 200 are assembled together by the screws 400. In this embodiment, the metal shell 200 is a shell of a notebook.

Figure 3:
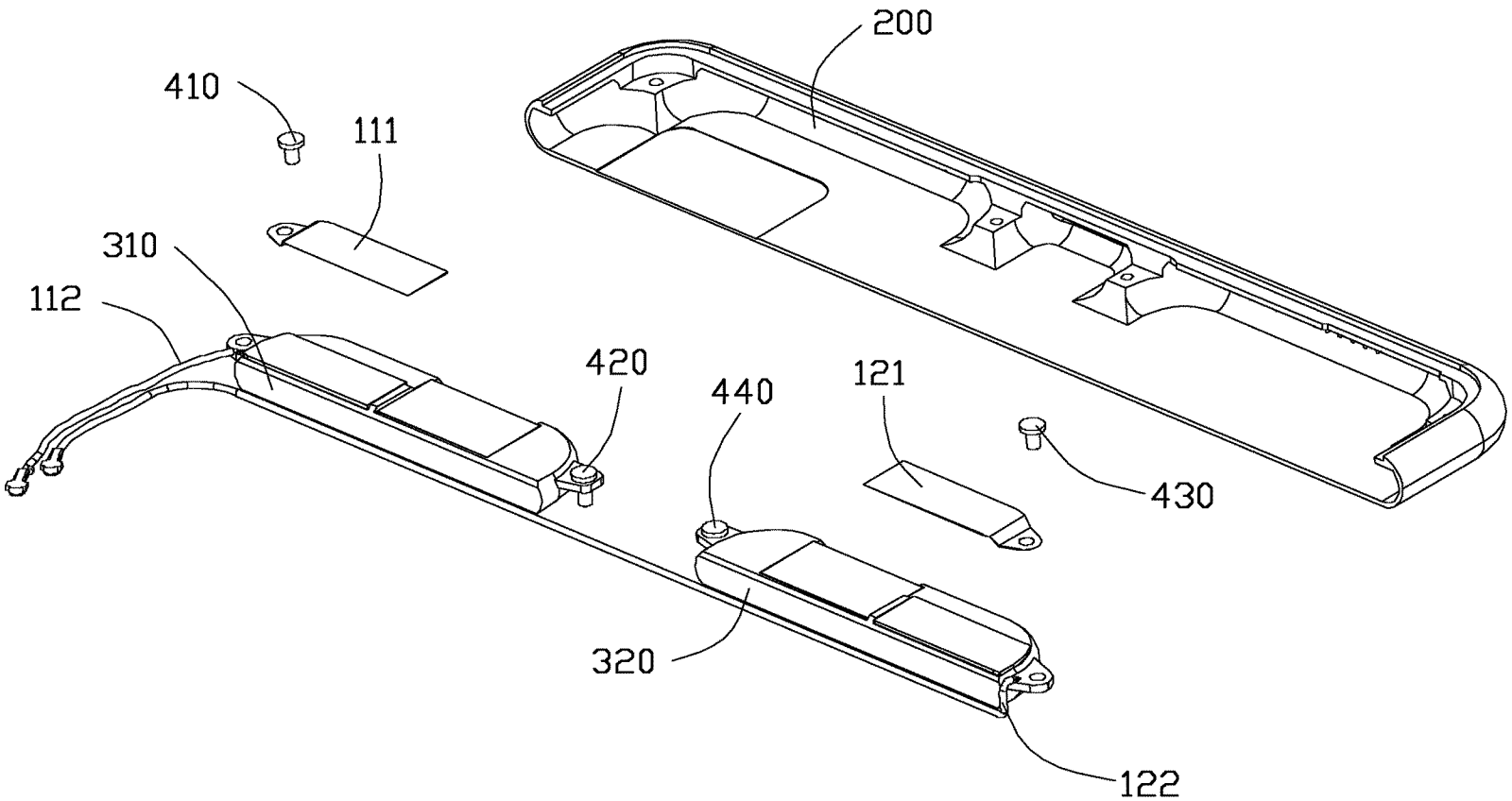
FIG. 3 is a further exploded perspective view of the antenna assembly of FIG. 2.
Figure 4:
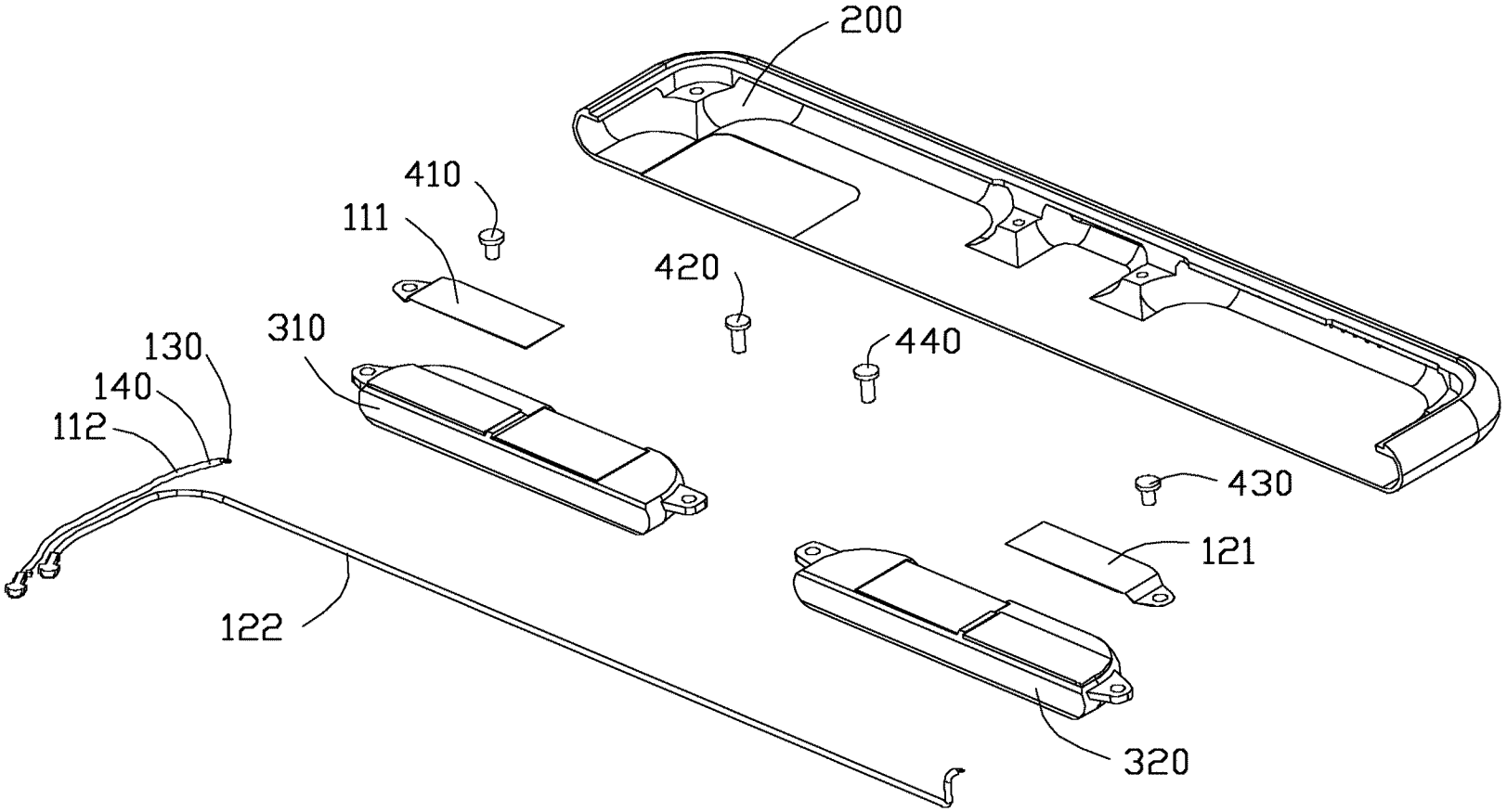
FIG. 4 is a further exploded perspective view of the antenna assembly of FIG. 3.

The antennas 100 include a first antenna 110 and a second antenna 120. The first antenna 110 includes a first main body 111 and a first feeder cable 112 connecting to the first main body 111. The second antenna 120 includes a second main body 121 and a second feeder cable 122 connecting to the second main body 121. The structure of the first main body 111 is similar to the structure of the second main body 121, the first main body 111 and the second main body 121 are called the main body in the following description. Referring to FIGS. 3-4, the speakers 300 includes a first speaker 310 and a second speaker 320, the screws 400 include a first screw 410, a second screw 420, a third screw 430 and a fourth screw 440. The first antenna 110 and one end of the first speaker 310 are fixed to the metal shell 200 by the first screw 410, and the other end of the first speaker 310 is fixed to the metal shell 200 by the second screw 420. The second antenna 120 and one end of the second speaker 320 are fixed to the metal shell 200 by the third screw 430, and the other end of the second speaker 320 is fixed to the metal shell 200 by the fourth screw 440.

Figure 5:
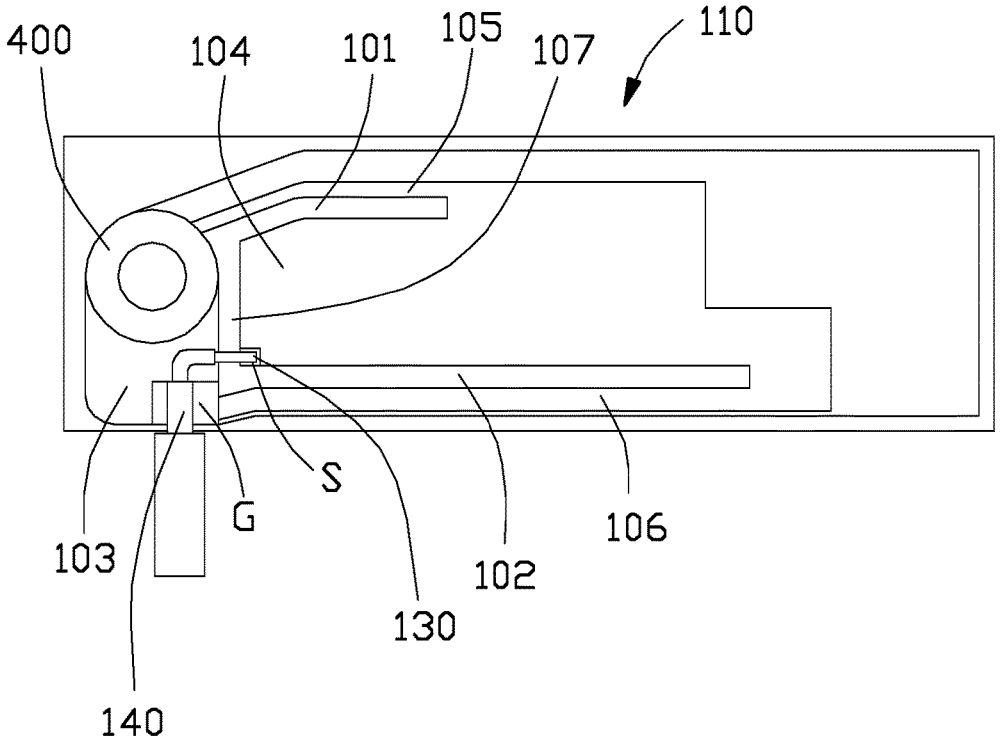
FIG. 5 is a front view of the first antenna of FIG. 4.

The first and second main bodies (111,121) shown in FIG. 1 to FIG. 4 are schematic diagrams. The detailed structure is shown in FIG. 5. Referring to FIG. 5, the main body (111,121) includes a grounding portion 103, a cantilevered arm or primary base 104 disposed by one side of the grounding portion 103, a first connecting portion 105 and a second connecting portion 106 connecting the grounding portion 103 with the cantilevered arm 104. The cantilevered arm 104 has a free end, the free end has a signal feeding point S. The grounding portion 103 has a grounding feeding point G. The first connecting portion 105 connects the grounding portion 103 with an upper portion of the cantilevered arm 104, and forms a first slot 101 between the cantilevered arm 104 and the first connecting portion 105. The second connecting portion 106 connects the grounding portion 103 with a lower portion of the cantilevered arm 104, and forms a second slot 102 between the cantilevered arm 104 and the second connecting portion 106. A length of the first slot 101 is larger than a length of the second slot 102. In this embodiment, the first slot 101 and the second slot 102 extend along a lengthwise direction while the third slot extends along a transverse direction perpendicular to said lengthwise direction. The free end of the cantilevered arm 104 is spaced from the grounding portion 103 with therebetween a third slot 107 which is connected to both the first slot 101 and the second slot 102. The feeder cable (112,122) includes an inner conductor 130 and a metallic weave 140 surrounding the inner conductor 130, the inner conductor 130 connects to the signal feeding point S, the metallic weave 140 connects to the grounding feeding point G. The grounding portion 103 is connected to the metal shell 200 by the first screw 410.

Figure 6:
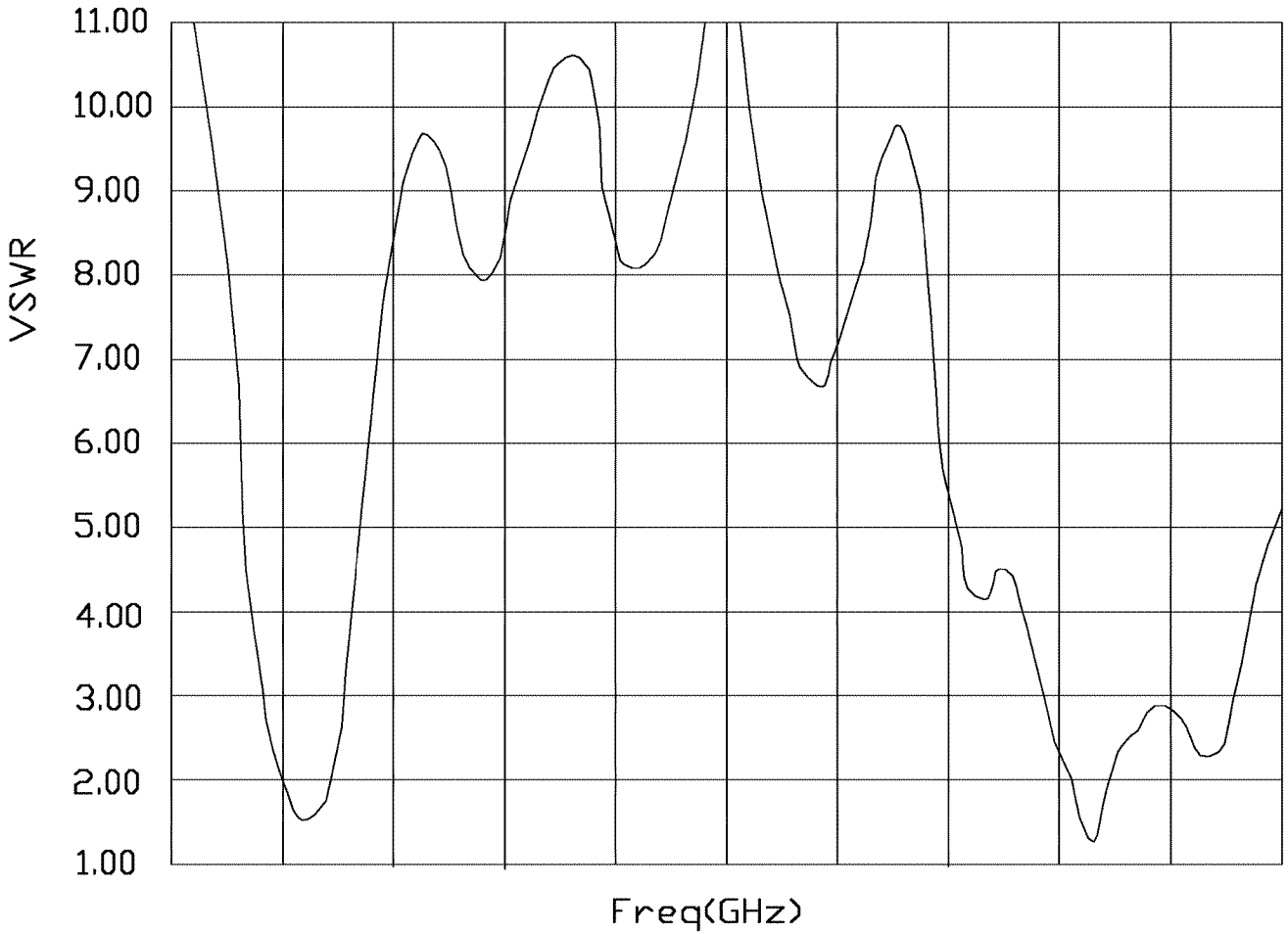
FIG. 6 is a Voltage Standing Wave Ratio Chart of the antenna in accordance with the present invention.

FIG. 6 is a Voltage Standing Wave Ratio Chart of the antenna 100 in accordance with the present invention. The main body (111,121) and the metal shell 200 are coupled and this controls the antenna 100 working in a 2.4 Ghz frequency band. The working frequency of the antenna 100 is more lower when the square of the main body (111,121) is more larger. The working frequency of the antenna 100 is more higher when the square of the main body (111,121) is more smaller. The antenna 100 can adjust the impedance by changing the length of the first slot 101, that is, the impedance of the antenna 100 and the characteristic impedance of the feeder cable can be in a matching state by adjusting the internal resistance of the main body. The antenna 100 adjusts the length of the second slot 102 to control the working frequency band in 5 Ghz. The working frequency of the antenna 100 is more lower when the length of the second slot 102 is more longer. The working frequency of the antenna 100 is more higher when the length of the second slot 102 is more shorter. In this embodiment, the antenna 100 is fixed in the speaker 300, and the antenna can also be fixed in a component having an insulative surface in other embodiments.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An antenna comprising:

a main body having a grounding portion, a cantilevered arm facing to the grounding portion, a first connecting portion connecting the grounding portion with the cantilevered arm, and a second connecting portion connecting the grounding portion with the cantilevered arm, and a feeder cable connecting to the main body;

wherein the first connecting portion is located above the cantilevered arm and connects the grounding portion with the cantilevered arm to form a first slot between the first connecting portion and the cantilevered arm, the second connecting portion locates under the cantilevered arm to form a second slot between the second connecting portion and the cantilevered arm, the cantilevered arm has a free end close to the grounding portion and having a signal feeding point thereon, the grounding portion has a grounding feeding point thereon.

2. The antenna as claimed in claim 1, wherein the second slot is longer than the first slot.

3. The antenna as claimed in claim 1, wherein the feeder cable has an inner conductor and a metallic weave surrounding the inner conductor, the inner conductor connects to the signal feeding point, the metallic weave connects to the grounding feeding point.

4. An antenna assembly comprising:

an antenna having a main body and a feeder cable connecting to the main body;

a component having an insulative surface for attaching with the main body, a metal shell receiving the component therein; and a first screw fixing the antenna to the metal shell, wherein the antenna, the component and the metal shell are retained together by the first screw extending through the antenna and the component to fix with the metal shell; wherein the antenna assembly also comprises a second screw for fixing the component to the metal shell; wherein the main body comprises a grounding portion, the grounding portion has a grounding feeding point, the first screw electrically connects the grounding portion to the metal shell.

5. The antenna assembly as claimed in claim 4, wherein the main body also comprises a cantilevered arm disposed at one side of the grounding portion, the cantilevered arm has a free end, the free end has a signal feeding point.

6. The antenna assembly as claimed in claim 5, wherein the feeder cable has an inner conductor and a metallic weave surrounding the inner conductor, the inner conductor connects to the signal feeding point, the metallic weave connects to the grounding feeding point.

7. An antenna assembly comprising:

a metallic shell forming a receiving space;

a case located in the receiving space for sound transmission and forming opposite upper and bottom surfaces, said bottom surface intimately confronting an interior surface of the shell;

an antenna, for use with both a high and a low working frequencies, extending in a plane defined by a lengthwise direction and a transverse direction perpendicular to each other, said antenna being attached upon the upper surface and including a conductive grounding portion conductively connected to the shell via a metallic fastening device which secures the case to the shell, a conductive primary base located beside said grounding portion in said lengthwise direction, and a slot structure partially surrounding the primary base and including a first slot extending generally along the lengthwise direction to adjust a matching impedance, and a second slot extending generally extending along the lengthwise direction to decide the high working frequency.

8. The antenna assembly as claimed in claim 7, wherein said slot structure further includes a third slot located between the primary base and the grounding portion and linking the first slot and the second slot.

9. The antenna assembly as claimed in claim 8, wherein said third slot extends along the transverse direction.

10. The antenna assembly as claimed in claim 8, further including a feeder cable equipped with an inner conductor soldered to the primary base and an outer metallic weave soldered to the grounding portion around an intersection area of said second slot and said third slot.

11. The antenna assembly as claimed in claim 10, wherein said feeder cable is located beside the fastening device in the transverse direction.

12. The antenna assembly as claimed in claim 8, wherein said primary base is configured with a cantilevered manner.

13. The antenna assembly as claimed in claim 8, wherein a dimension of the slot structure decides a dimension of the primary base which decides the lower working frequency.

14. The antenna assembly as claimed in claim 7, wherein said fastening device secures the antenna to the case.

15. The antenna assembly as claimed in claim 7, wherein said fastening device is a screw.

16. The antenna assembly as claimed in claim 7, wherein said second slot extends longer than said first slot in said lengthwise direction.

17. The antenna assembly as claimed in claim 7, wherein the case is insulative.

18. The antenna assembly as claimed in claim 7, wherein said fastening device is located around one lengthwise end of said antenna in said lengthwise direction.

* * * * *